US009189995B2

(12) United States Patent
Messmer

(10) Patent No.: US 9,189,995 B2
(45) Date of Patent: Nov. 17, 2015

(54) SYSTEMS AND METHODS FOR CONTROLLING DRIVE SIGNALS IN SPATIAL LIGHT MODULATOR DISPLAYS

(75) Inventor: Neil Messmer, Langley, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 265 days.

(21) Appl. No.: 13/375,306

(22) PCT Filed: Jul. 13, 2010

(86) PCT No.: PCT/US2010/041768

§ 371 (c)(1), (2), (4) Date: Nov. 30, 2011

(87) PCT Pub. No.: WO2011/008724

PCT Pub. Date: Jan. 20, 2011

(65) Prior Publication Data

US 2012/0075360 A1 Mar. 29, 2012

Related U.S. Application Data

(60) Provisional application No. 61/225,195, filed on Jul. 13, 2009.

(51) Int. Cl.

| | |
|---|---|
| ***G09G 5/10*** | (2006.01) |
| ***G09G 3/36*** | (2006.01) |
| ***G09G 3/34*** | (2006.01) |

(52) U.S. Cl.

CPC ..... *G09G 3/3406* (2013.01); *G09G 3/3426* (2013.01); *G09G 2320/0261* (2013.01); *G09G 2320/06* (2013.01); *G09G 2320/0646* (2013.01); *G09G 2320/0653* (2013.01); *G09G 2320/103* (2013.01); *G09G 2340/16* (2013.01)

(58) Field of Classification Search

CPC ... G09G 3/3406; G09G 3/3413; G09G 3/342; G09G 3/3426; G09G 2310/0237

USPC ..... 345/102, 690

See application file for complete search history.

(56) References Cited

U.S. PATENT DOCUMENTS

| | | | | |
|---|---|---|---|---|
| 6,891,672 | B2 | 5/2005 | Whitehead | |
| 7,154,459 | B2 | 12/2006 | Lee | |
| 7,173,599 | B2 | 2/2007 | Nishimura | |
| 7,277,076 | B2 | 10/2007 | Shiomi | |
| 7,312,777 | B2 | 12/2007 | Miyata | |
| 7,342,564 | B2 | 3/2008 | Ham | |
| 7,362,296 | B2 | 4/2008 | Song | |
| 7,403,332 | B2 | 7/2008 | Whitehead | |
| 2005/0184952 | A1 | 8/2005 | Konno | |
| 2005/0231457 | A1 * | 10/2005 | Yamamoto et al. | 345/102 |

(Continued)

FOREIGN PATENT DOCUMENTS

| | | |
|---|---|---|
| EP | 1788550 | 5/2007 |

*Primary Examiner* — Alexander Eisen
*Assistant Examiner* — Amit Chatly

(57) ABSTRACT

Methods and systems are provided for processing control values for a backlight and/or a display modulation layer of a display. A ramping pattern is determined based on the difference between new and old control values. A blanking pattern is determined based on the motion detected in frame regions. The ramping pattern or blanking pattern may take into consideration the display modulation layer response characteristics. The ramping pattern and/or blanking pattern is applied to control values for the backlight and/or display modulation layer.

20 Claims, 6 Drawing Sheets

(56) References Cited

U.S. PATENT DOCUMENTS

| | | | | |
|---|---|---|---|---|
| 2005/0248553 | A1 | 11/2005 | Feng | |
| 2006/0125771 | A1 | 6/2006 | Inuzuka | |
| 2006/0214905 | A1* | 9/2006 | Okazaki | 345/102 |
| 2007/0057900 | A1 | 3/2007 | Huang | |
| 2007/0103424 | A1 | 5/2007 | Huang | |
| 2007/0285382 | A1* | 12/2007 | Feng | 345/102 |
| 2008/0042968 | A1 | 2/2008 | Oh | |
| 2008/0079686 | A1 | 4/2008 | Cernasov | |
| 2008/0111835 | A1 | 5/2008 | Hu | |
| 2008/0180466 | A1 | 7/2008 | Whitehead | |
| 2008/0284719 | A1 | 11/2008 | Yoshida | |
| 2012/0092395 | A1 | 4/2012 | Seetzen | |

* cited by examiner

SYSTEMS AND METHODS FOR CONTROLLING DRIVE SIGNALS IN SPATIAL LIGHT MODULATOR DISPLAYS

CROSS-REFERENCE TO RELATED APPLICATIONS

This application claims priority to U.S. Patent Provisional Application No. 61/225,195, filed 13 Jul. 2009, hereby incorporated by reference in its entirety.

TECHNICAL FIELD

This invention relates to displays having a backlight and a display modulation layer. Particular embodiments provide for systems and methods for controlling the backlight and/or the display modulation layer to adjust for response characteristics of the backlight and/or the display modulation layer.

BACKGROUND

In a spatial light modulator display, light from a backlight may be directed at and spatially modulated by a display modulation layer to provide an image to the viewer. In such a display, the backlight may have an array of light sources (e.g. an array of light-emitting diodes (LEDs)) and the display modulation layer may have an array of pixels (e.g. liquid crystal display (LCD) pixels). For dual modulation displays, the LEDs may be driven to spatially modulate the intensity of light directed at the display modulation layer and the LCD pixels may be driven to modulate the amount of light transmitted through the pixels. Some examples of dual modulation displays are described in: U.S. Pat. No. 6,891,672 issued 10 May 2005 and entitled "High Dynamic Range Display Devices", U.S. Pat. No. 7,403,332 issued 22 Jul. 2008 and entitled "High Dynamic Range Display Devices", and United States Patent Application Publication No. 2008/0180466 published 31 Jul. 2008 and entitled "Rapid Image Rendering on Dual-Modulator Displays".

Drive values are generated based on image data, and are output to the backlight and the display modulation layer to control the image displayed on the display. For example, where the light sources are LEDs and the display modulation layer is an array of LCD pixels, LED drive values may drive the LEDs to emit light having particular luminous intensities, and LCD pixel drive values may drive the LCD pixels to assume particular transmissive states.

The time it takes for an LCD pixel to switch from one transmissive state associated with one LCD pixel drive value to another transmissive state associated with another LCD pixel drive value (i.e. the step response time of the LCD pixel) is typically much greater than the time it takes for an LED to switch between ON and OFF states, or from one luminous intensity level associated with one LED drive value to another luminous intensity level associated with another LED drive value (i.e. the step response time of the LED). For example, the step response time of an LCD pixel can be on the order of a few milliseconds or higher, whereas the step response time of an LED can be much shorter, for example, 10 to 100 nanoseconds. In some cases, it may take more than one frame period for an LCD pixel to transition from a current transmissive state to the desired transmissive state associated with a particular drive level.

The response characteristics of the LEDs and/or LCD pixels may affect the displayed image, for example, resulting in image blurring, flickering, halos or other visual artifacts that may be perceived by the viewer. Some references describing attempts to address image display issues of types that may be associated with the response characteristics of the backlight and/or LCD pixels in a display are:

- United States Patent Application Publication No. 2007/0285382 published 13 Dec. 2007 (Feng);
- United States Patent Application Publication No. 2007/0103424 published 10 May 2007 (Huang);
- United States Patent Application Publication No. 2008/0042968 published 21 Feb. 2008 (Oh);
- United States Patent Application Publication No. 2007/0057900 published 15 Mar. 2007 (Huang);
- United States Patent Application Publication No. 2008/0079686 published 3 Apr. 2008 (Cemasov);
- United States Patent Application Publication No. 2005/0248553 published 10 Nov. 2005 (Feng et al.);
- U.S. Pat. No. 7,173,599 issued 6 Feb. 2007 (Nishimura);
- United States Patent Application Publication No. 2006/0125771 published 15 Jun. 2006 (Inuzuka et al.);
- U.S. Pat. No. 7,312,777 issued 25 Dec. 2007 (Miyata et al.); and
- United States Patent Application Publication No. 2008/0111835 published 15 May 2008 (Hu).

There is a general desire to provide displays which provide a high-quality viewing experience. There is a general desire to provide systems and methods for ameliorating and/or overcoming image display issues related to the response characteristics of the backlight and/or display modulation layer in a display.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In addition to the exemplary aspects and embodiments described above, further aspects and embodiments will become apparent by reference to the drawings and by study of the following detailed descriptions.

BRIEF DESCRIPTION OF DRAWINGS

In drawings which illustrate non-limiting embodiments.

DESCRIPTION

Figure 1A:
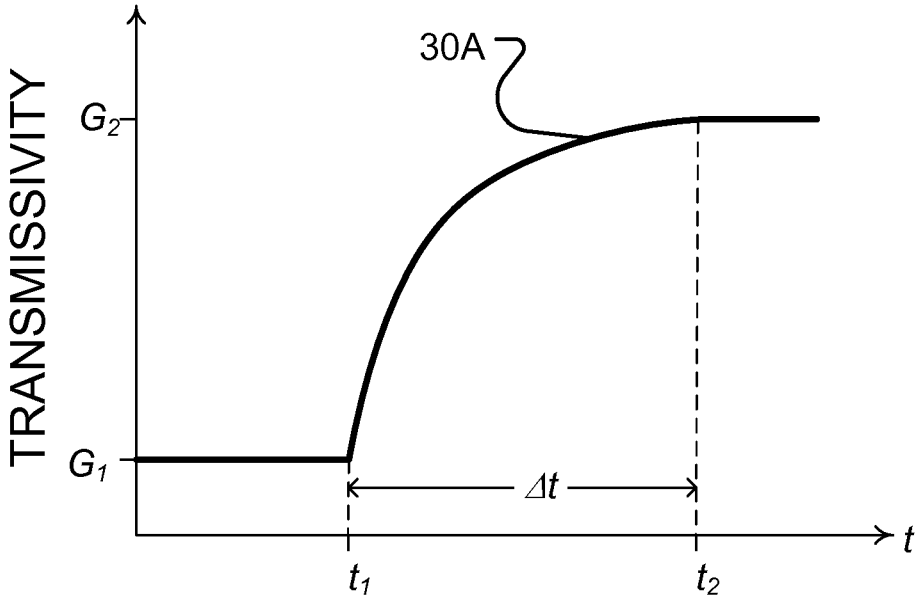
FIGS. 1A and 1B are graphs of the transmissivity G of an LCD pixel as functions of time, showing the step response of the LCD pixel.

Throughout the following description, specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

As discussed above, a display having a backlight and a display modulation layer may be subject to image display issues relating to the different response characteristics (e.g. step response times) of the backlight and display modulation layer. For example, in a display having an array of LCD pixels for the display modulation layer and an array of LEDs for the backlight, the step response time of the LCD pixels may be far greater than the step response time of the LEDs. Particular embodiments of the invention provide systems and methods for controlling a backlight and/or display modulation layer to adjust for the response characteristics of the backlight and display modulation layer. The embodiments described herein may be applied to displays which have a backlight incorporating an array of LEDs (or other light sources having relatively fast step response times) and a display modulation layer incorporating an array of LCD pixels (or other pixels having relatively slow step response times). In particular embodiments, the backlight is a spatially modulated light source layer (e.g. the LEDs may be modulated to provide a spatially varying light pattern to the display modulation layer).

Image data is used to determine how the luminous intensity of the light sources of the backlight and the transmissivities of pixels in the display modulation layer should change from one frame to the next. In some embodiments, where the actual change in transmissivity of a display modulation layer pixel occurs relatively slowly, the light sources may be controlled so that the change in the light source intensity from the present intensity level to the next intensity level is slowed (e.g. the light source intensity can be ramped over time).

The actual amount of time required for a display modulation layer pixel to change from a first transmissivity state to a second transmissivity state may depend upon the first and second transmissivity states. In some embodiments, the amount of change in the desired transmissivity of the display modulation layer pixels is identified by a function of drive values for the light sources and/or display modulation layer pixels. In some embodiments, cases in which a relatively long time may be required for a specified change in transmissivity of a display modulation layer pixel are identified by large changes in drive values of the light sources and/or display modulation layer pixels.

In some embodiments, cases in which relatively slow changes in transmissivity of display modulation layer pixels are expected are identified based on the drive values of the light sources (e.g. LEDs) of the backlight, as determined from image data.

Techniques for determining drive values for the light sources may involve nearest neighbor interpolation or the like and may be based on factors such as intensity or color specified by the image data. Example techniques are described in United States Patent Application Publication No. 2008/0180466 published 31 Jul. 2008 and entitled "Rapid Image Rendering on Dual-Modulator Displays". For each light source, the drive value for a new frame of image data (i.e. new light source drive value) is compared to the drive value corresponding to an old or previous frame of image data (i.e. old light source drive value).

If the difference between the new light source drive value and the old light source drive value exceeds a predetermined threshold value, the light source drive signal for the new frame of image data is adjusted and the adjusted light source drive signal is output to the light source. In particular embodiments, the light source drive signal is adjusted to ramp the luminous intensity of the light source. The luminous intensity may be ramped either up or down to reach the luminous intensity level associated with the new light source drive value. Ramping may be determined based on the difference between new and old light source drive values and/or the display modulation layer response characteristics. Ramping may occur over the time period in which it takes the display modulation layer pixels corresponding to the light source to reach or settle at the transmissivity states associated with the new pixel drive values.

If the difference between the new light source drive value and the old light source drive value does not exceed the predetermined threshold value, the light source drive signal for the new frame of image data may be output to the light source without the adjustments described above.

In some embodiments, each light source provides a non-negligible amount of light to several display modulation layer pixels. In such embodiments, it may not always be necessary to change the drive levels for a display modulation layer pixel by a large amount to achieve the desired output luminance pattern for a displayed image. For example, for some frames it may be sufficient to modulate only the intensity of the light source(s) corresponding to the display modulation layer pixels to achieve the desired output luminance pattern. For other frames, it may be sufficient to modulate the transmissivity of the display modulation layer pixels by small amounts, along with modulating the intensity of the light source(s) corresponding to the display modulation layer pixels, to achieve the desired output luminance pattern.

Cases in which the transmissivity of display modulation layer pixels may take especially long to transition to new values may be identified by desired output luminance values P for the pixels. Such output luminance values may be determined from the image data. In particular embodiments, large changes in transmissivity of a display modulation layer pixel may be predicted by comparing the difference between the output luminance value P and the average output luminance value $P_{AVE\ new\ frame}$ for the new frame or a region of the new frame (i.e. $\Delta P_{new\ frame}$), with the difference between the output luminance value P and the average output luminance value $P_{AVE\ old\ frame}$ for the old frame or a region of the old frame (i.e. $\Delta P_{old\ frame}$). Where the backlight incorporates multiple light sources (e.g. LEDs), each frame region over which the output luminance values P are averaged may correspond to a single light source. For example, the frames may be divided into frame regions which are at the resolution of the LEDs. In other embodiments, the frames may be divided into frame regions which are at a different resolution than the LEDs (e.g. a lower resolution than the LEDs, such that each frame region corresponds to multiple light sources). A large change in transmissivity of a display modulation layer pixel may be identified if the difference $|\Delta P_{new\ frame}-\Delta P_{old\ frame}|$ exceeds a threshold value.

In other particular embodiments, a large change in transmissivity of display modulation layer pixels may be identified if the difference $|\Delta P_{new\ frame}-\Delta P_{old\ frame}|$ summed over the pixels in a particular frame region exceeds a threshold value. If a large change in transmissivity of display modulation layer pixels is identified, the light source drive signal for the new frame of image data may be adjusted as described above (e.g. the light source intensity may be ramped over time). The adjusted light source drive signal is output to the light sources.

In some embodiments, the difference $|\Delta P_{new\ frame}-\Delta P_{old\ frame}|$ is compared over a series of frames to identify the rate of change in luminance values between frames. Such rate of change may be used to identify motion in a frame or frame region. For example, motion may be identified if there is a large increase in desired output luminance of display modulation layer pixels (which triggers ramping up of the luminous intensity of the light sources), followed by a large decrease in desired output luminance of display modulation layer pixels (which triggers ramping down of the luminous intensity of the light sources). Identification of motion may trigger blanking of the light source(s) as described in further detail below.

In some circumstances, blanking of the light source(s) for a selected frame region may provide a better viewing experience (e.g. so as to display a sharper image of a moving object or an image that is free of halos and other visual artifacts). For example, blanking may provide a better viewing experience for: fast moving objects; small moving objects; and/or bright objects moving across a dark background. Blanking may comprise turning a light source off or dimming the light source significantly during portion(s) of a frame.

According to particular embodiments, a blanking pattern is applied to light source drive values if the light source provides a non-negligible amount of light for: a frame region in which there is motion above a predetermined threshold amount, and/or a frame region which is in the path of a bright object moving against a dark background, and/or a frame region which is in the path of a small moving object (referred to herein as "blanking conditions"). In certain embodiments, motion above a predetermined threshold amount may be identified by determining the rate of change in desired output luminance values P for the pixels as determined from image data. The rate of change in desired output luminance values P may be determined by comparing the values of $|\Delta P_{new\ frame} - \Delta P_{old\ frame}|$ over a series of frames.

The blanking pattern may be determined based on the amount of motion, type of motion or blanking condition (e.g. fast moving object, small moving object, or bright object) and/or the display modulation layer response characteristics. According to particular embodiments, the blanking pattern is determined based on the rate of change in desired output luminance values P. The blanking pattern may be adjusted in accordance with display modulation layer response characteristics.

The blanking pattern is applied to the light source drive values, which may be calculated from the image data using suitable techniques, as noted above. In some embodiments, a separate blanking signal may be applied to the light source to enable and disable the light source.

For light sources corresponding to frame regions in which the amount of motion does not exceed the predetermined threshold amount, the light source drive values may be output without blanking to the light sources.

According to particular embodiments, ramping and/or blanking is applied to light source drive values. The new light source drive value may be compared to the old light source drive value. If the difference between the new light source drive value and the old light source drive value exceeds a predetermined threshold value, a ramping pattern is applied to the light source drive values for the new frame of image data so as to ramp the luminous intensity of the light source. The luminous intensity may be ramped either up or down over the LCD pixel step response time to reach the luminous intensity level associated with the new light source drive value.

In addition to ramping patterns, a blanking pattern may be applied to a light source drive value if one or more blanking conditions (as described above) is satisfied for the light source. As described above, the blanking pattern may be determined based on the amount of motion, type of motion or blanking condition, and/or the display modulation layer response characteristics. The ramping pattern and blanking pattern are applied to the light source drive values and the resulting drive signal is output to the light source.

Figure 7:
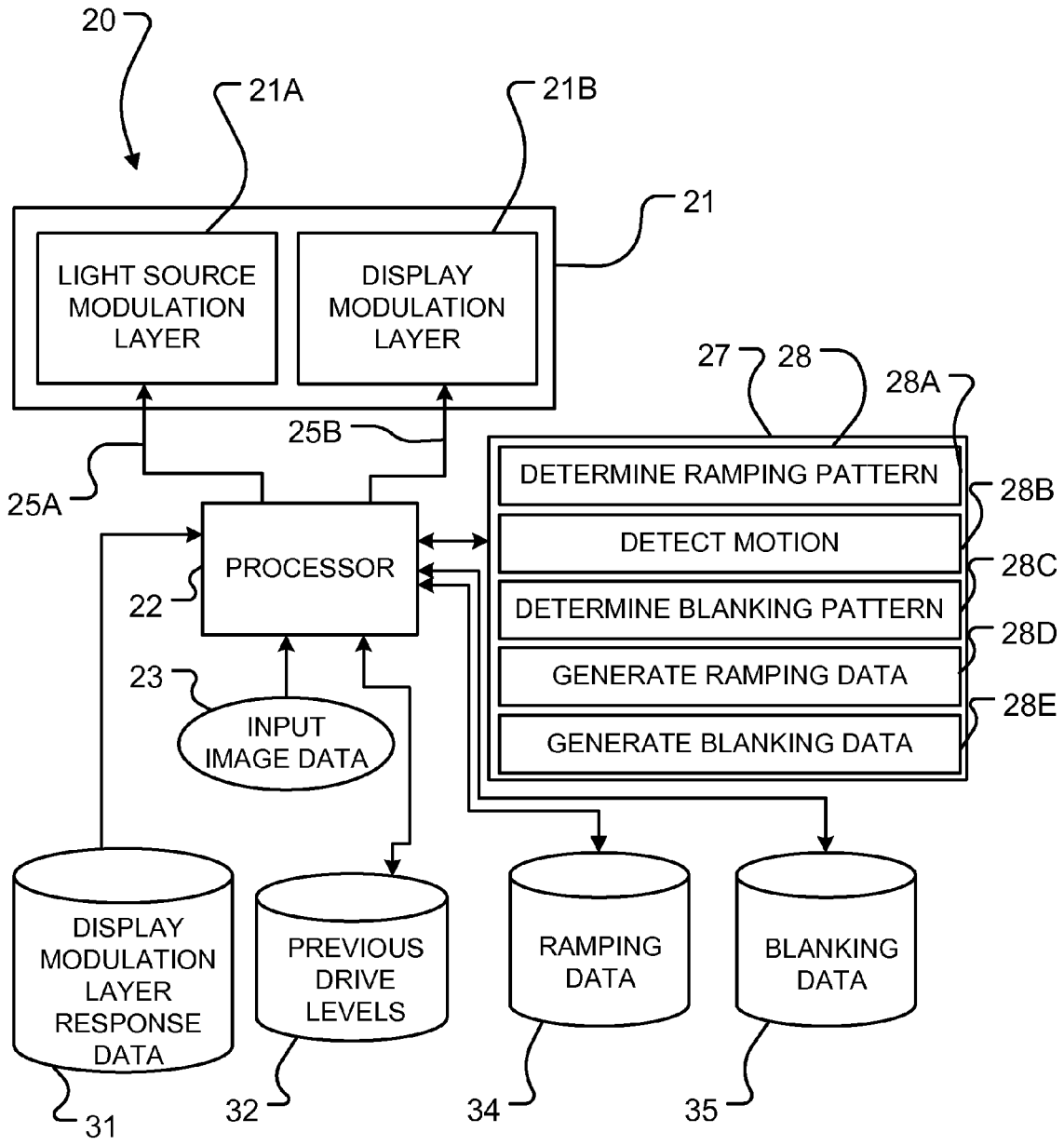
FIG. 7 schematically illustrates a system that may be used to implement methods like those of FIGS. 4, 5 and 6.

FIG. 7 shows a dual modulation display system 20 according to a particular embodiment of the invention. Display system 20 may operate to display image data 23. Display system 20 may be configured to perform the methods of the invention. Display system 20 comprises a display 21. In some embodiments, display 21 comprises a high brightness and/or high dynamic range (HDR) display. For example, display 21 may have maximum luminance values in the range of 400 to 10,000 cd/m$^2$. Display 21 may have a contrast ratio of 200,000:1 or more. In the illustrated embodiment, display 21 comprises a dual modulation display having a light source modulation layer 21A and a display modulation layer 21B.

System 20 also comprises a processor 22, which may comprise one or more central processing units (CPU), one or more microprocessors, one or more field-programmable gate arrays (FPGA), application-specific integrated circuits (ASIC), logic circuits combinations thereof or any other suitable processing unit(s) comprising hardware and/or software capable of functioning as described herein. Processor 22 processes image data 23 to generate light source modulator control values 25A to drive the light source modulation layer 21A, and display modulator control values 25B to drive the display modulation layer 21B. In particular embodiments, light source modulation layer 21A comprises a matrix of LEDs. In such embodiments, control values 25A provided to light source modulation layer 21A may comprise digital LED drive values which may be converted to analog LED drive values (e.g. drive currents) or pulse width modulation (PWM) signals or the like. In some embodiments, display modulation layer 21B comprises an array of LCD pixels. In such embodiments, control values 25B provided to display modulation layer 21B may comprise corresponding LCD pixel drive values, which may be converted to analog LCD drive values.

Processor 22 may implement methods according to embodiments of the invention by executing software instructions provided by software functions 28. In the illustrated embodiment, software functions 28 are stored in a program memory 27, but this is not necessary. Software functions 28 may be stored in other suitable memory locations within or accessible to processor 22. In some embodiments, all or portions of software functions 28 may alternatively be implemented by suitably-configured hardware.

Figure 2:
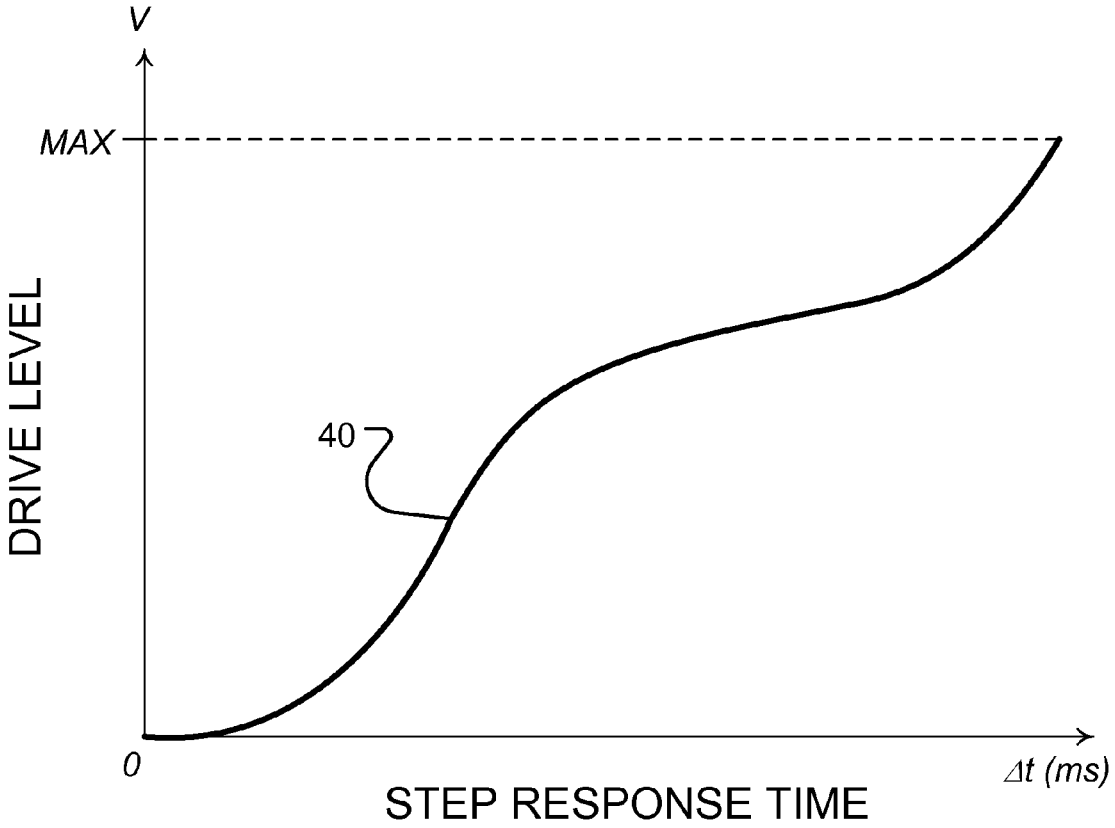
FIG. 2 is a graph mapping LCD pixel drive values to step response time.

In the illustrated embodiment, processor 22 has access to display modulation layer response data or LCD response transfer model 31 which, as shown in the illustrated embodiment, may be stored in a suitable data store. Display modulation layer response data 31 may comprise information such as the step response time of the LCD pixels of display modulation layer 21B (e.g. step response times associated with particular LCD pixel drive value changes, as shown in FIG. 2 and described in further detail below).

In the illustrated embodiment, processor 22 has access to ramping data 34 and blanking data 35, which may be stored in suitable data store(s). Ramping data 34 may incorporate information about how to ramp an LED (or other light source) from one particular LED drive value to another particular LED drive value (e.g. time period over which the LED is ramped). Blanking data 35 may incorporate information about how to control blanking of the LED drive signal (e.g. rate of blanking, duration of blanking, etc.) for a particular type or amount of motion, or blanking condition, detected in a frame region. In some embodiments, ramping data 34 and blanking data 35 (stored in suitable data store(s)) may be directly provided with system 20. In other embodiments, processor 22 may access display modulation layer response data 31 and use such data to generate ramping data 34 and blanking data 35. In some embodiments, processor 22 may generate ramping data 34 and blanking data 35 using transfer functions implemented by suitable hardware and/or software.

In the illustrated embodiment, processor 22 also has access to information about previous drive levels 32 (e.g. previous control values 25A and/or previous control values 25B) which may be stored in a suitable data store. As explained in more detail below, previous drive levels 32, ramping data 34, blanking data 35 and/or display modulation layer response data 31 may be used by processor 22 to determine and adjust control values 25A and/or control values 25B for new frames of image data 23.

In some embodiments, display modulation layer response data 31, ramping data 34 and blanking data 35 may be provided in the form of look-up table(s) (LUT(s)). A suitable key may be used to access data from the LUTs. For example, the difference between the new light source drive value and the old light source drive may be used as a key for accessing data from an LUT containing ramping data 34. The amount of motion (e.g. speed of a moving object as represented by a motion vector) in a frame region may be used as a key for accessing data from an LUT containing blanking data 35.

In other embodiments, ramping data 34 and blanking data 35 may be determined by transfer functions implemented by hardware and/or software. Previous drive levels 32 (e.g. previous control values 25A and/or previous control values 25B) and control values 25A and/or control values 25B for a new frame of image data 23 may be used as inputs to the transfer functions. Ramping data 34 and/or blanking data 35 are outputs of the transfer functions.

Figure 1B:
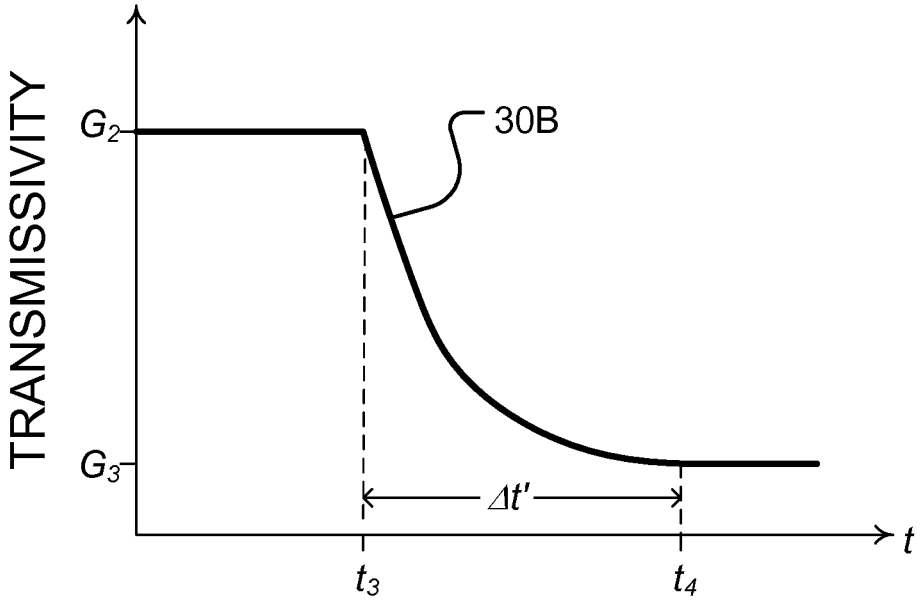

The step response time of an LCD pixel, along with other considerations, may be used to determine display modulation layer response data 31, ramping data 34 and/or blanking data 35. FIGS. 1A and 1B show the transmissivity G of an exemplary LCD pixel as functions 30A, 30B of time t. In FIG. 1A, the LCD pixel starts in a first transmissive state $G_1$ associated with a first drive value. At time $t_1$, a second drive value corresponding to a second transmissive state $G_2$ is applied to the LCD pixel causing the LCD pixel to transition to the second transmissive state $G_2$ over a time period $\Delta t$ (i.e. the step response time). The LCD pixel reaches the second transmissive state $G_2$ at time $t_2$.

In FIG. 1B, the LCD pixel starts in the second transmissive state $G_2$ associated with the second drive value. At time $t_3$, a third drive value corresponding to a third transmissive state $G_3$ is applied to the LCD pixel causing the LCD pixel to transition to the third transmissive state $G_3$ over a time period $\Delta t'$ (i.e. the step response time). The LCD pixel reaches the third transmissive state $G_3$ at time $t_4$.

Time period $\Delta t'$ (FIG. 1B) may differ from time period $\Delta t$ (FIG. 1A). The step response time between LCD pixel drive values may vary according to one or more of: the amount of change in LCD pixel drive values (i.e. the size of the step between LCD pixel transmissive states), the direction of change (i.e. whether the LCD pixel is being driven toward a higher or a lower transmissive state), the initial transmissive state, display-specific LCD response characteristics, and other considerations. Methods as described herein may monitor one or more of these factors. In some embodiments it is sufficient to monitor the amount of change between pixel drive values.

FIG. 2 illustrates the relationship between LCD pixel step response time and the amount of change in drive levels. FIG. 2 shows a curve 40 mapping LCD pixel drive values (measured in Volts) to the LCD pixel step response time (measured in milliseconds) for a representative display modulation layer. The step response time in FIG. 2 represents the amount of time that it takes for an LCD pixel to transition from a transmissivity state associated with a drive value of zero to a transmissivity state associated with an LCD pixel drive value on the FIG. 2 "Drive Level" axis. As seen in FIG. 2, the step response time generally increases as the LCD pixel drive value increases.

Figure 4:
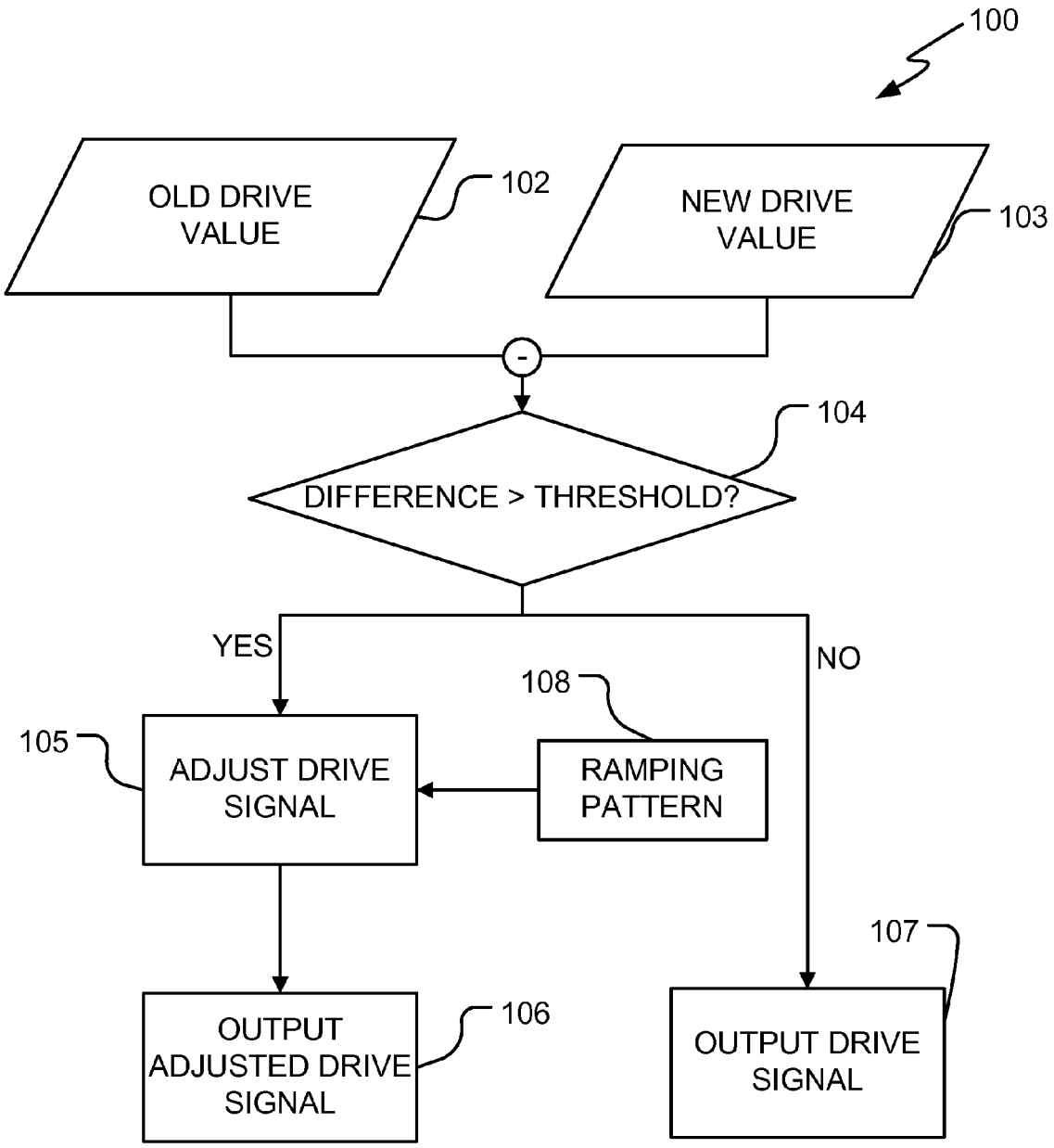
FIG. 4 is a flow chart of a method according to an example embodiment.

FIG. 4 illustrates a method 100 for processing control values 25A for light source modulation layer 21A according to a particular embodiment. The method illustrated in FIG. 4 may be implemented by display system 20 for display on dual modulation display 21 (FIG. 7). Such method may be implemented by other suitable image processing hardware and/or software. Method 100 represents a method for processing a control value 25A for a light source (e.g. LED) of a light source modulation layer 21A for a new frame of image data 23. Method 100 may be performed for each LED of light source modulation layer 21A to determine control values 25A for all LEDs of light source modulation layer 21A for the new frame of image data 23. Method 100 may be repeated for multiple frames of image data 23 to determine control values 25A for light source modulation layer 21A. Control values 25A for an LED may be updated multiple times per frame of image data 23 in accordance with the adjusted LED drive signal (e.g. so as to ramp the luminous intensity of the LED) as explained in more detail below.

Method 100 begins by comparing the LED drive value corresponding to the new frame of image data 23 (i.e. new LED drive value, at block 103) with the LED drive value corresponding to the old or previous frame of image data 23 (i.e. old LED drive value, at block 102). The new LED drive value at block 103 may be determined from the new frame of image data 23. The old LED drive value at block 102 may be obtained by accessing the data store containing previous drive levels 32 (FIG. 7). After method 100 has been completed for a particular frame update, the new, adjusted LED drive value determined at the end of the frame update may be stored in the data store containing previous drive levels 32 for future use as an "old" LED drive value (e.g. for processing control values 25A for the next frame of image data 23).

If the difference between the new LED drive value and the old LED drive value exceeds a threshold value at block 104, the LED drive signal for the new frame is adjusted at block 105. The adjusted LED drive signal is output to the LED at block 106. The threshold value considered at block 104 may be set taking into account display modulation layer response data 31 such as LCD pixel step response times. Generally, the LCD step response time increases as the difference between new and old LCD pixel drive values increases (see FIG. 2, for example). A large difference between new and old LED drive levels may identify a large difference between new and old LCD pixel drive values. The threshold value may be programmable.

In particular embodiments, the LED drive signal is adjusted at block 105 to ramp the LED luminous intensity. The LED drive signal may be adjusted to ramp the luminous intensity upwardly or downwardly over the LCD pixel step response time to the luminous intensity level associated with the new LED drive value. The luminous intensity of the LED over the ramping period may be controlled to change at a rate which corresponds at least roughly to the expected rate of change in transmissivity of the LCD pixel (e.g. see FIG. 1A, 1B).

In some embodiments, the difference between the new LED drive value and the old LED drive value is clamped to a maximum value (i.e. the new LED drive value is clamped such that the LED drive value is only permitted to change by the maximum value from one frame to the next). The LED drive signal may be adjusted to ramp the luminous intensity from the level associated with the old LED drive value to the level associated with the new, clamped LED drive value.

According to particular embodiments, ramping pattern 108 may be based on the difference between the new LED drive value and the old LED drive value. A large difference between the new LED drive value and the old LED drive value may identify a large step or change in LCD pixel drive values. The LCD pixel step response time tends to increase as the change in LCD pixel drive values increases (see FIG. 2, for example). Accordingly, the difference between the new LED drive value and the old LED drive value may be used to determine the time period over which ramping is to occur. The time period may be incorporated in a ramping pattern 108 which is applied to adjust the LED drive signal at block 105 of method 100.

Adjustment of the LED drive signal at block 105 of method 100 (so as to ramp the LED luminous intensity over the LCD pixel step response time, for example) may be performed by processor 22 implementing a suitable software function 28A (FIG. 7). Function 28A may cause processor 22 to access previous drive levels 32, ramping data 34 and/or display modulation layer response data 31 to determine ramping pattern 108 to be applied to the LED drive values.

Ramping of LED luminous intensity may be implemented by any suitable technique. For example, ramping may be accomplished by one of the following techniques or a combination thereof:

- PWM (e.g. by varying the PWM duty cycle of the LED drive signal);
- amplitude modulation (e.g. by varying the current applied to drive the LED);
- alternating current (AC) drive phase angle modulation (e.g. by driving the LEDs with a full wave rectified AC form);
- pulse density modulation (PDM);
- and the like.

If the difference between the new LED drive value and the old LED drive value does not exceed the predetermined threshold value, it may not be necessary to adjust the LED drive signal for LCD response characteristics. In the illustrated embodiment, if the difference between the new LED drive value and the old LED drive value does not exceed the predetermined threshold value, the new LED drive value is output to the light source at block 107 of method 100 without the adjustments (e.g. ramping) described above.

Figure 3:
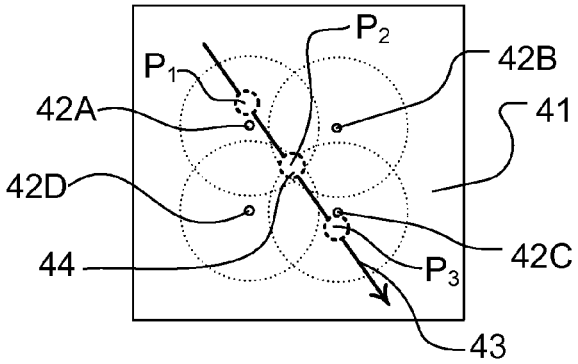
FIG. 3 depicts four LEDs in a frame region which is in the path of a moving object.

According to some embodiments, rather than or in addition to comparing a difference between new and old drive values for a single LED at block 104, the cumulative difference between new and old drive values for a plurality of adjacent LEDs within a frame region may be compared to a predetermined threshold value at block 104. This may enhance processing of LED drive signals for scenarios such as those shown in FIG. 3. FIG. 3 shows four adjacent LEDs 42A, 42B, 42C and 42D (collectively, LEDs 42) providing light for a frame region 41. Each LED 42 contributes a non-negligible amount of light to a central area 44 between the four LEDs 42. An object is shown moving in a path 43 across frame region 41. The object is represented in stippled lines at different positions $P_1$, $P_2$ and $P_3$ as it moves along path 43. At position $P_1$, the object is proximate to LED 42A. For frames in which the object is moving to and away from position $P_1$ along path 43, the difference between new and old drive values for LED 42A is large, and may exceed the predetermined threshold value thereby triggering ramping of the LED drive signal for LED 42A. Similarly, for frames in which the object is moving to and away from position $P_3$ (at which the object is proximate to LED 42C), the difference between new and old drive values for LED 42C is large, and may exceed the predetermined threshold value thereby triggering ramping of the LED drive signal for LED 42C.

At position P2 (between positions P1 and P3), the object is crossing central area 44. Because central area 44 has non-negligible light contributions from all four LEDs 42, the difference between new and old drive values for each of the LEDs 42 for frames in which the object is moving across central area 44 may individually be small enough to be below the threshold value used to evaluate the difference between new and old drive values for individual LEDs. However, cumulatively, the difference between new and old drive values for LEDs 42 during such frames may be large enough that ramping of the LED signals may be desired. According to particular embodiments, the difference between new and old drive values for each of the four LEDs 42 is combined (e.g. by summing) and the result is compared to a threshold value (which may not be the same as the threshold value for comparing new and old drive values for individual LEDs). If such combined change exceeds the threshold value, a ramping pattern 108 is determined for each of the four LEDs 42 and applied to the LED drive signals.

According to some other embodiments, ramping of LED luminous intensity may be determined based on an "intermediate" downsampling of the desired output luminance values P for the pixels. The desired output luminance values P for the pixels (as obtained from image data) which is at the resolution of the LCD pixels, are downsampled to an intermediate resolution that is less than the LCD pixel resolution and greater than the physical LED resolution. For example, the desired output luminance values P may be downsampled to a resolution which is four times greater than the physical LED resolution (e.g. each LED corresponds to four downsampled data samples of the output luminance values P). The downsampled data is then evaluated to determine whether ramping of LED luminous intensity should occur. The difference between new and old values for each of the downsampled data samples could be compared, for example, to a threshold value. Downsampling of the data enables a finer detection of motion or changes in brightness within an area defined by an LED region. If it is determined on the basis of the downsampled data that ramping of LED luminous intensity should occur, the ramping pattern may be based on the changes in, or difference between new and old values of the downsampled data. The intermediate downsampled data may be further downsampled to match the physical LED resolution, to determine LED drive values. The ramping pattern is applied to the LED drive values.

Figure 5:
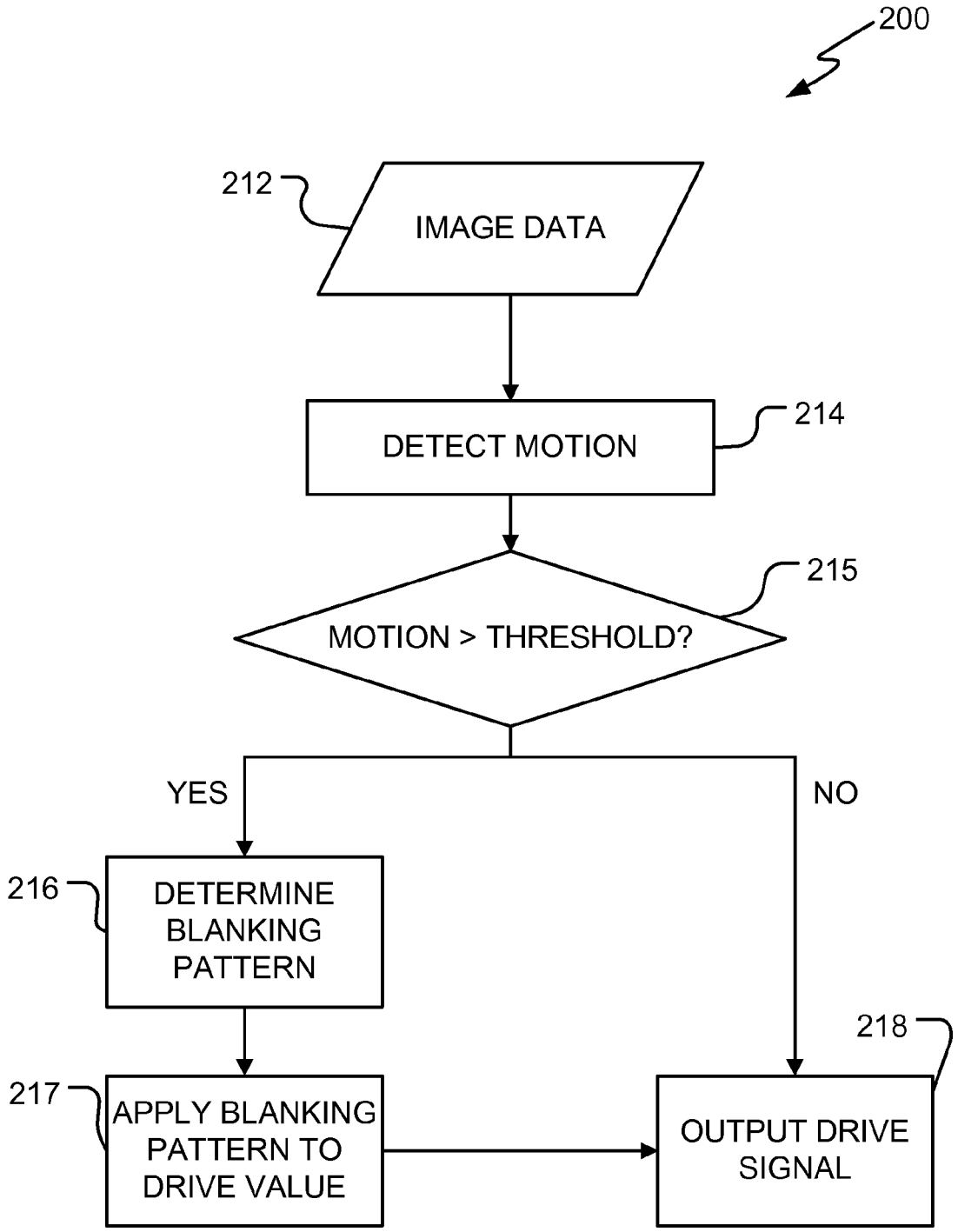
FIG. 5 is a flow chart of a method according to another example embodiment.

FIG. 5 shows a method 200 according to another embodiment for processing control values 25A for light sources (e.g. LEDs) of a light source modulation layer 21A. The method illustrated in FIG. 5 may be implemented by display system 20 for display on dual modulation display 21 (FIG. 7). Such method may be implemented by other suitable image processing hardware and/or software. The steps illustrated in method 200 may be applied for a series of frames of image data 23 to determine control values 25A for light source modulation layer 21A.

Method 200 begins at block 212 by receiving image data corresponding to a series of frames. Motion in one or more frame regions is detected at block 214. Motion detection at block 214 may assess whether one or more of the following blanking conditions is satisfied for an LED of light source modulation layer 21A:

- The LED provides a non-negligible amount of light for a frame region in which there is motion above a predetermined threshold amount. Image data may incorporate motion information. For example, MPEG compressed data incorporates motion vectors. In some embodiments, motion information from the image data may be used to determine and quantify motion. In other embodiments, motion may be detected based on some other characteristic of the image data (e.g. rate of change in desired output luminance values P over a series of frames), or by monitoring the amount of change in LED drive values or LCD pixel drive values in a frame region over the series of frames.

The LED provides a non-negligible amount of light for a frame region which is in the path of a bright object moving against a dark background.

The LED provides a non-negligible amount of light for a frame region which is in the path of a small moving object (e.g. a small object relative to the point spread function of the light source).

Motion detection at block 214 may be performed by processor 22 implementing a suitable software function 28B (FIG. 7). For example, in embodiments where motion information incorporated in image data is used to detect motion, function 28B may cause processor 22 to evaluate motion vectors in image data 23 to determine motion. For example, where image data is provided in an MPEG format, MPEG motion vectors may be evaluated to identify LEDs or other light sources for which blanking may be desirable.

Flanking may be determined for frame regions on an LED by LED basis. The motion detected at block 214 is assessed to determine whether blanking should be applied to the LED. Generally, blanking may be applied to LEDs in the advance and trailing areas of a moving object. The blanking determination may take into account the fact that multiple LEDs may contribute a non-negligible amount of light to a frame region in which motion is detected.

For example, in the illustrated embodiment, the blanking determination may be carried out by quantifying the motion detected and comparing the amount of motion to a threshold amount at block 215. In particular embodiments, motion may be quantified by considering the speed of a moving object as represented by a motion vector in the image data. In other embodiments, motion may be quantified by considering the rate of change in desired output luminance values P for the pixels as determined from image data. For example, the rate of change in desired output luminance values P may be determined by considering $|\Delta P_{new\ frame}-\Delta P_{old\ frame}|$, as described above.

If the amount of motion in the frame region exceeds the threshold amount, a blanking pattern for the frame region is determined at block 216 based on the amount of motion, type of motion, and/or the display modulation layer response characteristics. The block 216 blanking pattern may have a "blank" or "off" signal alternating with "on" or activation signals. The block 216 blanking pattern may cause the frame region to be blanked for portion(s) of a frame period. The block 216 blanking pattern may cause multiple "blank" signals alternating with "on" signals to be output to an LED during a frame period. A blanking pattern may be characterized by the number of "blank" signals inserted within a frame period (i.e. blanking rate), duration of each "blank" signal, and/or duration between the start of successive "blank" signals. The blanking of LEDs is preferably not detectable by the human viewer (e.g. the blanking rate is sufficiently high, and/or insertion of blank signals within a frame period may be randomized). According to particular embodiments, the blanking pattern is determined based on the rate of change in desired output luminance values P. For example, the blanking rate may be proportional to the rate of change in desired output luminance values P (i.e. a higher rate of change may be associated with a higher blanking rate). The blanking pattern may be adjusted in accordance with display modulation layer response characteristics. For example, the blanking rate may be increased for slower transitions (e.g. when there is a large change in pixel drive values), and decreased or disabled for faster transitions (e.g. when there is a small change in pixel drive values).

In particular embodiments, blanking may be accomplished by dimming the LEDs rather than by turning off the LEDs. In other embodiments, blanking may be accomplished by a combination of dimming the LEDs and turning off the LEDs.

Determination of the block 216 blanking pattern may be performed by processor 22 implementing a suitable software function 28C (FIG. 7). Function 28C may cause processor 22 to access image data 23, blanking data 35 and/or display modulation layer response data 31 to determine the blanking pattern to be applied to the light source drive values.

The block 216 blanking pattern is applied at block 217 to the LED drive values, which may be calculated from the image data using suitable techniques. The resulting blanked LED drive signal is output to the LED at block 218.

Blanking may be determined on a frame by frame basis. A different block 216 blanking pattern may be established for each frame, depending on the rate of change in output luminance values (as determined by comparing new and previous desired output luminance values P, for example) or the motion vectors contained in the image data. Where a comparison between new and previous desired output luminance values P is used to determine the blanking pattern, the new desired output luminance value at the end of a frame update may be stored in memory for later use as "previous" desired output luminance values in processing the next frame of image data.

In the illustrated embodiment, if the amount of motion detected in the frame region(s) does not exceed the predetermined threshold amount at block 215, the LED drive values are output, without blanking, to the LED at block 218.

Figure 6:
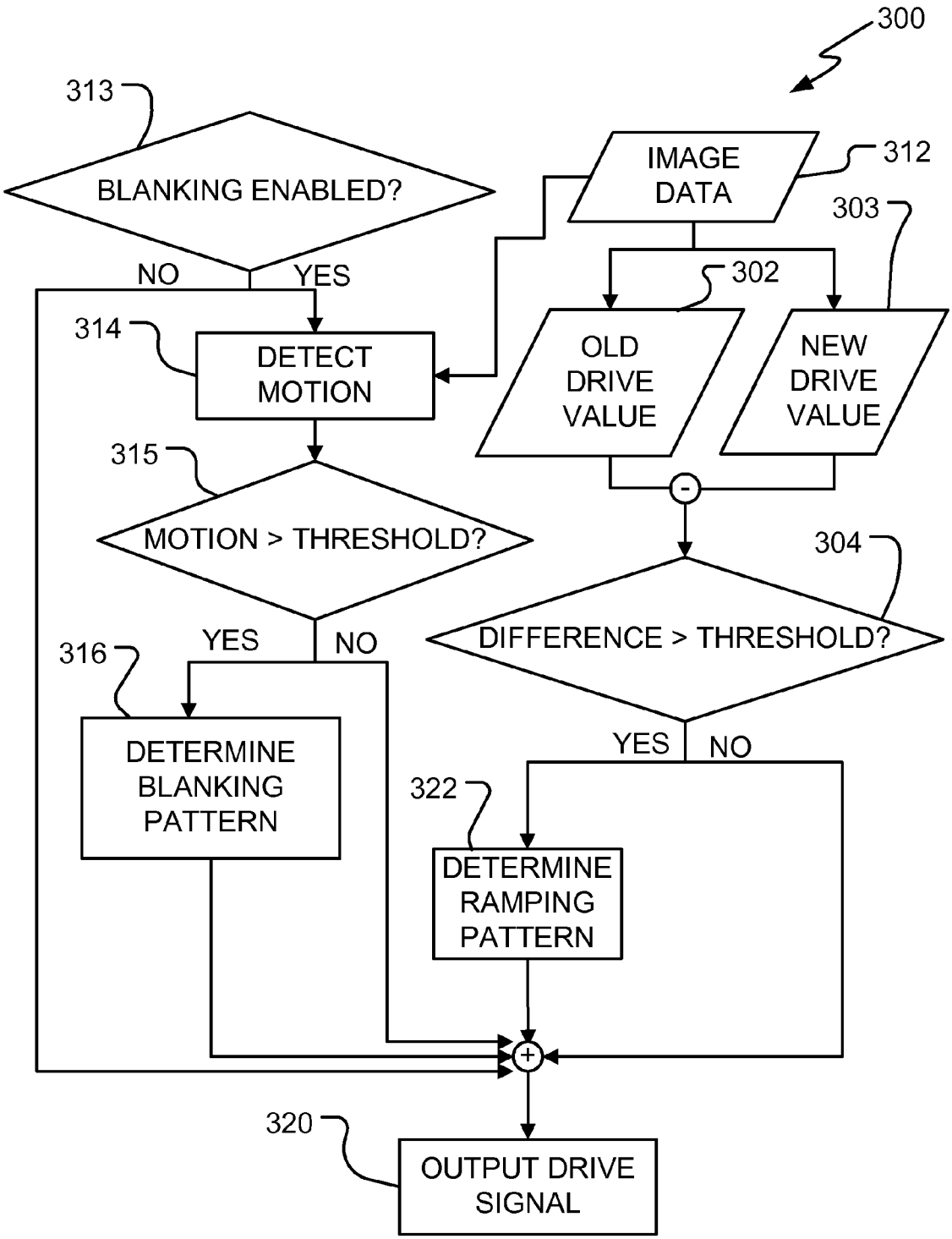
FIG. 6 is a flow chart of a method according to yet another example embodiment.

FIG. 6 illustrates a method 300 for processing control values 25A for light source modulation layer 21A according to yet another embodiment. The method illustrated in FIG. 6 may be implemented by display system 20 for display on dual modulation display 21 (FIG. 7). Such method may be implemented by other suitable image processing hardware and/or software. Method 300 is similar in some respects to methods 100 and 200. Aspects of method 300 that are the same or similar to aspects of methods 100 or 200 are ascribed similar reference numerals, except that in method 300, the reference numerals are prefixed with a "3" instead of a "1" or "2". Method 300 represents a method for processing a control value 25A for a light source (e.g. LED) of a light source modulation layer 21A for a new frame of image data 23. Method 300 may be performed on each LED of light source modulation layer 21A to determine control values 25A for all LEDs of light source modulation layer 21A for the new frame of image data 23. Method 300 may be repeated for multiple frames of image data 23 to determine control values 25A for light source modulation layer 21A. Control values 25A may be updated multiple times per frame of image data 23 in accordance with the adjusted LED drive signal (e.g. so as to ramp the luminous intensity of the LED).

Method 300 begins by receiving a new frame of image data 312. A new LED drive value at block 303 may be determined from the new frame of image data 312. An old LED drive value at block 302 may be obtained by accessing the data store containing previous drive levels 32 (FIG. 7). At block 304, a difference between the new LED drive value 303 and the old LED drive value 302 is compared to a predetermined threshold value. If the difference between the new LED drive value 303 and the old LED drive value 302 exceeds the predetermined threshold value, a ramping pattern is determined at block 322 to ramp the LED luminous intensity. The luminous intensity may be ramped either up or down to reach the luminous intensity level associated with the new LED drive value.

Determination of the block 322 ramping pattern of method 300 may be performed by processor 22 implementing a suitable software function 28A (FIG. 7). Function 28A may cause processor 22 to access previous drive levels 32, ramping data 34 and/or display modulation layer response data 31 to determine ramping pattern 322 to be applied to the LED drive value.

If the difference between the new LED drive value and the old LED drive value does not exceed the predetermined threshold value, the LED drive signal may not require adjustment for LCD response characteristics. In the illustrated embodiment, the LED drive signal for the new frame of image data is not ramped if the difference between the new LED drive value and the old LED drive value does not exceed the predetermined threshold value.

Method 300 incorporates blanking which may be carried out in parallel with the above-described ramping determination. If blanking is enabled at block 313, method 300 proceeds to block 314 by detecting motion in one or more frame regions. Detection of motion at block 314 may be performed by processor 22 implementing a suitable software function 28B (FIG. 7). Function 28B may cause processor 22 to process image data 23 to detect and quantify the motion in one or more frame regions.

Method 300 proceeds to block 315 where it is determined whether the LED provides a non-negligible amount of light for one or more frame regions in which there is motion above a threshold amount. If so, a blanking pattern is determined at block 316. The block 316 blanking pattern may be based on the amount of motion, type of motion and/or the display modulation layer response characteristics such as the LCD pixel step response times. Determination of the block 316 blanking pattern may be performed by processor 22 implementing a suitable software function 28C (FIG. 7). Function 28C may cause processor 22 to access image data 23, blanking data 35 and/or display modulation layer response data 31 to determine the blanking pattern to be applied to the new LED drive value at block 317.

According to some embodiments, different types of motion or blanking conditions may be detected at block 314 and assessed at block 315. Such motion or blanking conditions may be similar to those described above for block 214 in FIG. 2.

In the illustrated embodiment of FIG. 6, if it is determined at block 315 that the LED does not provide a non-negligible amount of light for a frame region in which there is motion above a predetermined threshold amount, the LED is not blanked.

The block 322 ramping pattern (if applicable) and block 316 blanking pattern (if applicable) are applied to the LED drive signal. The ramped and/or blanked drive signal is output to the LED at block 320. In particular embodiments, two parallel control paths may be provided for each LED (i.e. one control path for each of the ramping and blanking).

Blanking may be disabled by the user or if certain conditions are met. According to particular embodiments, blanking is disabled at block 313 if the difference between the new LED drive value at block 303 and the old LED drive value at block 302 does not exceed the predetermined threshold value (i.e. if a block 322 ramping pattern is not determined and applied to the LED drive signal). Therefore, according to such specific embodiments, blanking of the LED only occurs if the luminous intensity of the LED is ramped.

As seen in FIG. 7, display system 20 may be configured to perform a method according to the invention. In the illustrated embodiment, processor 22 calls software functions 28, such as function 28A to determine a ramping pattern to be applied to light source drive values, function 28B to detect motion in one or more frame regions, and function 28C to determine a blanking pattern to be applied to light source drive values.

In some embodiments, processor 22 may call software function 28D to generate data entries to populate an LUT containing ramping data 34. Processor 22 may also call software function 28E to generate data entries to populate an LUT containing blanking data 35. Ramping data 34 and blanking data 35 may be generated based on display modulation layer response data 31.

In other embodiments, an LUT containing ramping data 34 or blanking data 35 may be pre-populated with data, so that it is not necessary for processor 22 to generate such data. In still other embodiments, ramping data 34 or blanking data 35 may be determined by transfer functions implemented by hardware and/or software. Previous drive levels 32 (e.g. previous control values 25A and/or previous control values 25B) and control values 25A and/or control values 25B for a new frame of image data 23 may be used as inputs to the transfer functions.

In some embodiments, functions 28 may be implemented as software contained in a program memory 27 accessible to processor 22. Processor 22 may implement the methods of FIG. 4, 5 or 6 by executing software instructions provided by the software contained in program memory 27. In other embodiments, one or more of functions 28 or portions of functions 28 may be performed by suitably configured data processing hardware.

Aspects of the invention may also be provided in the form of a program product. The program product may comprise any medium which carries a set of computer-readable information comprising instructions which, when executed by a data processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, flash RAM, or the like. The computer-readable information on the program product may optionally be compressed or encrypted.

Where a component (e.g. a device, processor, light source modulation layer, display modulation layer, light source, LED, LCD pixel, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in light of the foregoing disclosure, many alterations and modifications are possible in the practice of this invention without departing from the spirit or scope thereof. For example:

The systems and methods described herein may be applied to process control values for a spatial light modulator display having a backlight comprised of an array of light sources (e.g. LEDs) and a display modulation layer comprised of an array of LCD pixels. The systems and methods described herein may generally be applied to any types of displays (e.g. TVs, cinematic screens, computer monitors, etc.) in which the response characteristics of the display modulation layer differ from those of the backlight.

Some of the systems and methods described herein compare new light source drive values with old light source drive values to determine whether the light source drive signal should be adjusted for the LCD pixel response characteristics. In other embodiments, instead of comparing light source drive values, new LCD pixel drive values may be compared with old LCD pixel drive values to determine whether the light source drive signal should be adjusted for the LCD pixel response characteristics.

In the embodiments described herein which incorporate blanking of light sources over one or more frame regions, the luminous intensity of the light sources may optionally be scaled upwards to compensate for the overall reduction in brightness of the frame region caused by blanking, and/or to adjust for the step response time of the LCD pixels (e.g. LCD pixels representing a bright object which is quickly moving across a dark background may not yet have had time to transition to their final transmissive states).

Many embodiments and variations are described above. Those skilled in the art will appreciate that various aspects of any of the above-described embodiments may be incorporated into any of the other ones of the above-described embodiments by suitable modification.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A method for processing control values for a backlight and drive signals for a display modulation layer, the backlight having an array of light sources, the method comprising, for each light source:

receiving image data for a new frame;

determining a new control value for the backlight based at least in part on the new frame of image data;

determining a difference between the new control value for the backlight and an old control value for the backlight for an old frame of image data;

generating an intermediate control signal for the backlight based at least in part on the difference in control values and a desired ramping pattern, if the difference between the old control value and the new control value is greater than a threshold;

generating a blanking pattern for the backlight, the blanking pattern based in part on the identification of motion over a set of image frames; and outputting a final control signal to the backlight based on the intermediate control signal and the blanking pattern.

2. A method according to claim 1, wherein generating an intermediate control signal comprises:

determining a ramping pattern;

determining a time period associated with the difference in control values; and applying the ramping pattern to the new control value over the time period.

3. A method according to claim 2, wherein the intermediate control signal drives the light source so as to cause a luminous intensity of the light source to change at a rate corresponding to a rate of change in transmissivity of the display modulation layer.

4. A method according to claim 3, wherein the intermediate control signal is generated only if the difference in control values is greater than a predetermined threshold value.

5. A method according to claim 4, wherein outputting a final control signal comprises:

detecting motion between the new frame of image data and the old frame of image data;

determining one or more frame regions in which the detected motion exceeds a predetermined threshold amount;

determining whether the light source provides a non-negligible amount of light for the one or more frame regions;

if the light source provides the non-negligible amount of light for the one or more frame regions, determining a blanking pattern based at least in part on the detected motion; and applying the blanking pattern to the intermediate control value.

6. A method according to claim 5, wherein the blanking pattern incorporates one or more blank signals over a frame period.

7. A method according to claim 6, wherein detecting motion is based at least in part on a rate of change in luminance values determined from a difference between desired output luminance values P for the new frame of image data and desired output luminance values P for the old frame of image data.

8. A method according to claim 7, wherein a number of the one or more blank signals over the frame period is proportional to the rate of change in luminance values.

9. A method according to claim 6, wherein detecting motion is based at least in part on motion vectors incorporated in the new frame of image data and the old frame of image data.

10. A method according to claim 6, wherein the light source comprises an LED and the display modulation layer comprises an array of LCD pixels.

11. A display system comprising:

a display having a light source modulation layer and a display modulation layer;

a first data store for storing data for display modulation layer response characteristics;

a second data store for storing light source modulation layer control values for previous frames of image data; and a processor connected to receive image data from an image data source, receive data from the first and second data stores, and transmit driving control values to the light source modulation layer, the processor configured to perform the method of claim 1.

12. A computer readable non-transitory storage media incorporating instructions which when executed by a suitable configured processor cause the processor to perform a method for processing control values for a backlight and drive signals for a display modulation layer, the backlight having an array of light sources, the method comprising, for each light source:

receiving image data for a new frame;

determining a new control value based at least in part on the new frame of image data;

generating an intermediate control signal for the backlight based at least in part on the difference in control values and a desired ramping pattern, if the difference between an old control value and the new control value is greater than a threshold;

generating a blanking pattern for the backlight, the blanking pattern based in part on the identification of motion over a set of image frames; and outputting a final control signal to the backlight based on the intermediate control signal and the blanking pattern.

13. A computer readable non-transitory storage media according to claim 12, wherein the method comprises, for each light source:

determining a ramping pattern;

determining a time period associated with the difference in control values; and applying the ramping pattern to the new control value over the time period.

14. A computer readable non-transitory storage media according to claim 13, wherein the intermediate control signal drives the light source so as to cause a luminous intensity of the light source to change at a rate corresponding to a rate of change in transmissivity of the display modulation layer.

15. A computer readable non-transitory storage media according to claim 14, wherein the intermediate control signal is generated only if the difference in control values is greater than a predetermined threshold value.

16. A computer readable non-transitory storage media according to claim 15, wherein outputting a final control signal comprises:

detecting motion between the new frame of image data and the old frame of image data;

determining one or more frame regions in which the detected motion exceeds a predetermined threshold amount;

determining whether the light source provides a non-negligible amount of light for the one or more frame regions;

if the light source provides the non-negligible amount of light for the one or more frame regions, determining a blanking pattern based at least in part on the detected motion; and applying the blanking pattern to the new control value.

17. A computer readable non-transitory storage media according to claim 16, wherein the blanking pattern incorporates one or more blank signals over a frame period.

18. A computer readable non-transitory storage media according to claim 17, wherein detecting motion is based at least in part on a rate of change in luminance values determined from a difference between desired output luminance values P for the new frame of image data and desired output luminance values P for the old frame of image data.

19. A computer readable non-transitory storage media according to claim 18, wherein a number of the one or more blank signals over the frame period is proportional to the rate of change in luminance values.

20. A computer readable non-transitory storage media according to claim 17, wherein detecting motion is based at least in part on motion vectors incorporated in the new frame of image data and the old frame of image data.

* * * * *